US007314019B1

(12) United States Patent
Curi et al.

(10) Patent No.: US 7,314,019 B1
(45) Date of Patent: Jan. 1, 2008

(54) RETRACTABLE STEP WITH SECURE LOCKING MECHANISM

(76) Inventors: Suzanna Curi, 5580 Camino De Bryant, Yorba Linda, CA (US) 92887; Joseph A. Curi, II, 5580 Camino De Bryant, Yorba Linda, CA (US) 92887

( * ) Notice: Subject to any disclaimer, the term of this patent is extended or adjusted under 35 U.S.C. 154(b) by 0 days.

(21) Appl. No.: 11/407,767

(22) Filed: Apr. 19, 2006

(51) Int. Cl.
*B63B 17/00* (2006.01)

(52) U.S. Cl. ..... 114/362

(58) Field of Classification Search ..... 114/362; 182/127; 280/166
See application file for complete search history.

(56) References Cited

U.S. PATENT DOCUMENTS

| | | | | |
|---|---|---|---|---|
| 2,653,036 | A * | 9/1953 | Creel et al. | 182/91 |
| 3,938,235 | A | 2/1976 | Wendt, III et al. | |
| 3,986,503 | A * | 10/1976 | Le Guillon | 182/89 |
| 3,990,120 | A | 11/1976 | Rankin | |
| 4,197,520 | A | 4/1980 | Smith et al. | |
| 4,204,286 | A | 5/1980 | Stiles et al. | |
| 4,312,515 | A | 1/1982 | Allori | |
| 4,423,757 | A | 1/1984 | Broberg, Jr. | |
| 4,425,987 | A | 1/1984 | Porter | |
| 4,625,349 | A | 12/1986 | Higgins | |
| 4,705,079 | A | 11/1987 | Higgins | |
| 5,022,117 | A | 6/1991 | Lautenschlager et al. | |
| 5,842,709 | A | 12/1998 | Maccabee | |
| 5,927,433 | A | 7/1999 | Jaramillo, Sr. | |
| 5,970,905 | A | 10/1999 | Jaramillo, Sr. | |
| 6,021,733 | A | 2/2000 | Jaramillo, Sr. | |
| 6,533,303 | B1 * | 3/2003 | Watson | 280/166 |
| 6,840,526 | B2 * | 1/2005 | Anderson et al. | 280/166 |
| 2004/0103699 | A1 | 6/2004 | Ho | |

* cited by examiner

*Primary Examiner*—Ed Swinehart
(74) *Attorney, Agent, or Firm*—Law Offices of David L. Hoffman

(57) ABSTRACT

A retractable U-shaped ladder assembly preferably for a craft such as a watercraft has a rotatably retracted ladder which is attached to the craft by brackets. A torsion spring is used to bias the ladder into the retracted position. While the ladder is in an in-use position, the ladder is locked into place by a locking mechanism. The locking mechanism includes a bent plate which presses against four rings that are fixed to a rod, which rod extends from each bracket. Each ring has a notch that is located in the same position. In the use position, the bent plate will fit into the notches of the rings and lock the step. When the user is finished using the ladder, the user can manually unlock the step by pressing the bent plate. The bent plate moves out of engagement with the notches in the rings, thereby allowing the torsion springs in the brackets to rotate the step to the retracted position.

16 Claims, 6 Drawing Sheets

RETRACTABLE STEP WITH SECURE LOCKING MECHANISM

BACKGROUND OF THE INVENTION

1. Field of the Invention

The present invention relates to a boat or watercraft step with an improved support and retracting mechanism, and in particular, to such a step having a locking mechanism for locking the step in the retracted position.

2. Description of the Related Art

In watercraft such as personal watercraft and boats, it is desirable to have an outboard step, which assists a user in boarding a personal watercraft or boat, e.g., from the water after falling off, swimming or water skiing. In U.S. Pat. No. 5,970,905 to the present inventor, a retractable telescopic and rotatable step for a watercraft is disclosed. The patent teaches a U-shaped retractable step that retracts both rotationally and axially, and is mounted to the underside of the transom of a personal watercraft. The step is biased into the storage position by a relatively strong torsion spring. It would be desirable to lock the step in place when it is in the deployed (use) position.

U.S. Pat. No. 5,842,709 to Maccabee discloses a retractable swing down step assembly which is motorized and which locks into the storage position. The lock is meant to keep the step in place while the vehicle it is attached to is moving. The lock is actuated electronically. It does not have a locking mechanism that locks a step into the use position.

U.S. Pat. No. 4,312,515 to Allori discloses a self-locking step assembly for a vehicle. The step swings out of the retracted position and into the use position. In both positions the step locks due to a pin that fits into a slot on a cylinder. The cylinder rotates and the pin locks it into place. However, this lock requires the step to be in such a position where gravitational force causes the step to lock into place. This lock is also weak and insufficient for use on a boat ladder such as the one in U.S. Pat. No. 5,970,705 described above.

There is a need for a lock for a step for a retractable ladder for a personal watercraft or boat which lock is for the use position and which is easily released.

SUMMARY OF THE INVENTION

In one embodiment, the invention provides a locking mechanism for a U-shaped ladder having a rung and two parallel tubes or sides. The ladder is rotationally biased to in the storage position. The bias is created from a pair of torsion springs that are in each bracket. When put into the use position by the user the ladder automatically locks into place until it is manually unlocked by the user. The locking mechanism prevents injury to the user when he or she is getting off the ladder because it prevents it from snapping back until the user is ready for it to retract.

In a preferred embodiment the locking mechanism includes a rod, a bent plate and rings or washers which form a cam surface. The rings or washers are fixed to the rod. The rod extends between the brackets of the ladder which are used to mount the ladder to the underside of the boat. The rod is rotationally biased in the same direction as the ladder because the rod is rotating with the ladder.

The bent plate is on an axis that is formed by two short rods. The bent plate is rotatable in a teeter-totter fashion on the axis. Another smaller torsion spring biases the bent plate in the opposite rotational direction as the ladder. When the ladder is in the storage position, the bent plate rests against the rings.

Each of the rings has a notch that is located in the same circumferential position. When the ladder is put into the use position, the bent plate is urged into the notches preventing retraction of the ladder. The lock may then be manually unlocked by the user when he or she is in a safe position to do so.

To unlock the ladder the user simply has to push on the top of the bent plate, rotating it against the bias of the smaller torsion spring so that the bottom of the bent plate is lifted out of the notches and the ladder is free to rotate back into the storage position.

DESCRIPTION OF THE PREFERRED EMBODIMENT(S)

Figure 1:
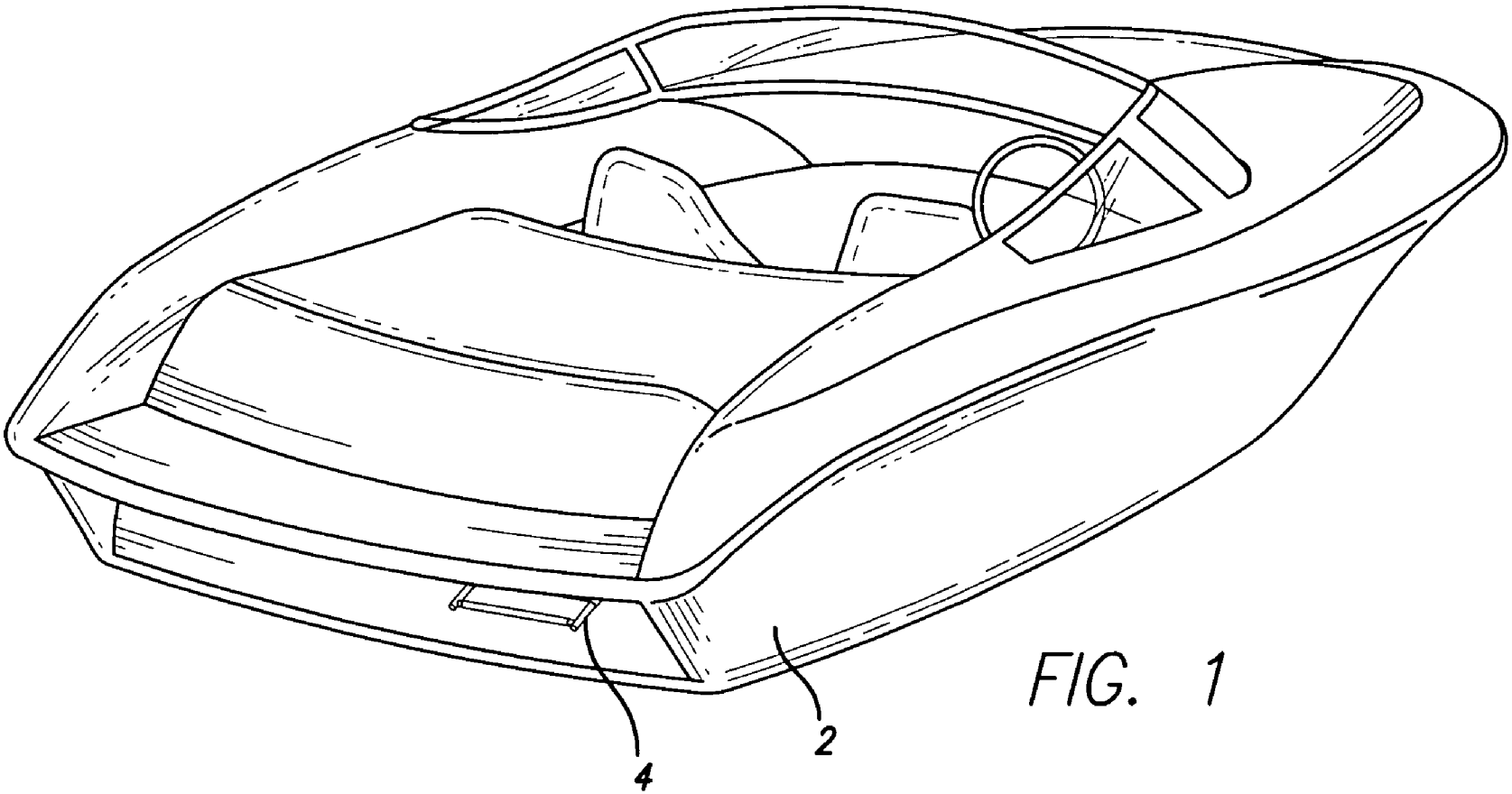
FIG. 1 is a perspective ladder assembly mounted to the underside of a boat and having a locking mechanism in accordance with a first embodiment of the invention.

In FIG. 1 a ladder assembly 4 in accordance with a preferred embodiment of the invention is mounted to the underside of a rear platform of a boat or personal watercraft 2. The ladder assembly includes a ladder 9, which is shown in the retracted position in FIG. 2. Ladder 9 is mounted by two bracket members 8 to underside 12 of the boat's rear platform. Each bracket assembly 8 includes two flanges 14 fixed by bolts 16 to the boat. The flanges extend in between two side walls 17 of each bracket 8.

The ladder 9 includes a first or base ladder having two parallel base tubes 22 joined by a rung 13. The invention may be embodied in a single rung ladder, but also may be embodied as shown in a multi-rung ladder having a telescoping second ladder member with two parallel telescoping tubes 23. The tubes 23 telescope within the base tubes 22, and a rung 11 connecting the two telescoping tubes 23. Such a structure is well known in the art. It is also possible to have even more rungs.

Figure 8:
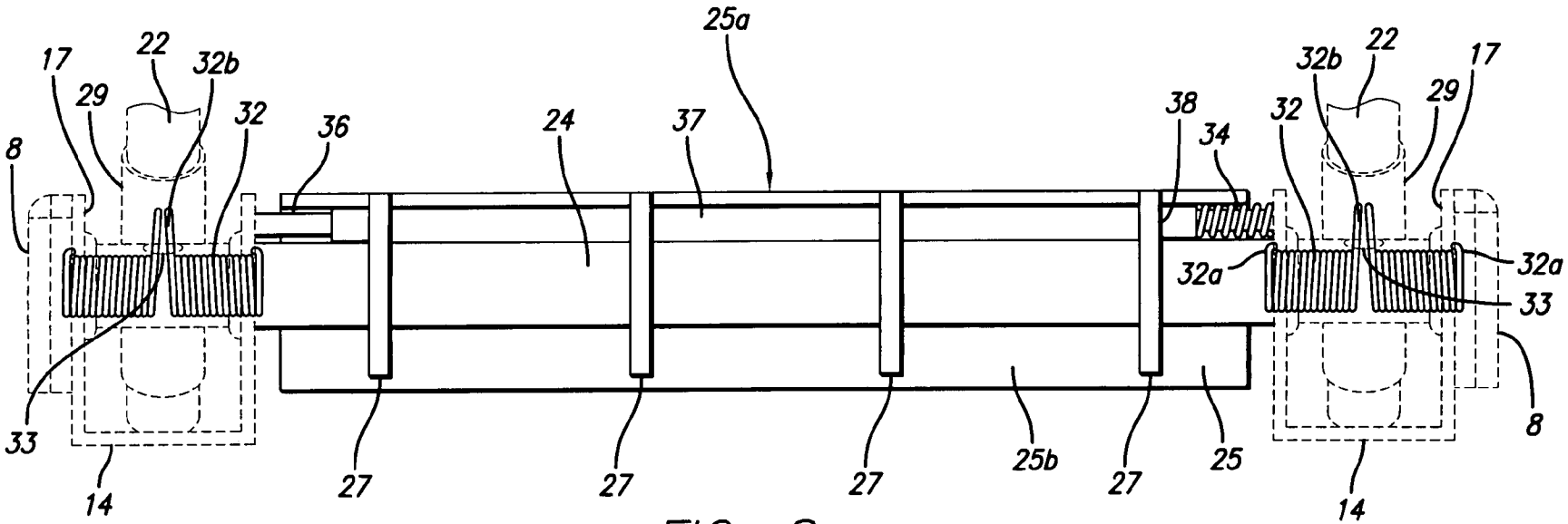
FIG. 8 is a bottom view of a cross member extending from one bracket to another.

As shown in FIG. 8, ladder assembly 4 includes two brackets 8 having a cross member 24 extending therebetween. Each bracket assembly further includes a spring assembly 32 biasing the ladder to its storage position (to rotate up toward the bottom of the rear platform of the boat). Spring assembly 32 includes one or two torsion springs. An advantage of two springs is that more torque may be obtained. One end 32*a* of each spring 32 connects to one side wall 17 of each bracket 8, e.g. by fitting into a slot. An opposite end 32*b* of each spring 32 connects to the cross member 24, e.g. by fitting into a slot 33 in the cross member 24.

Figure 6:
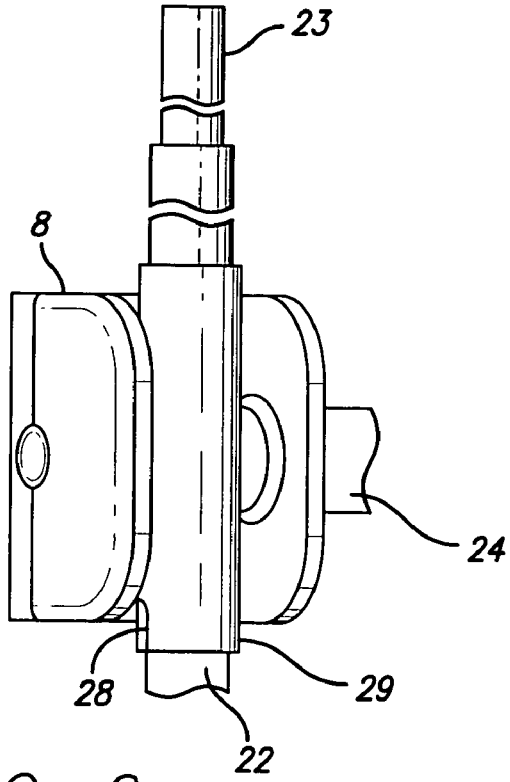
FIG. 6 is a perspective view of one of the brackets with the connected cylindrical sleeve having telescoping tubes.
Figure 7:
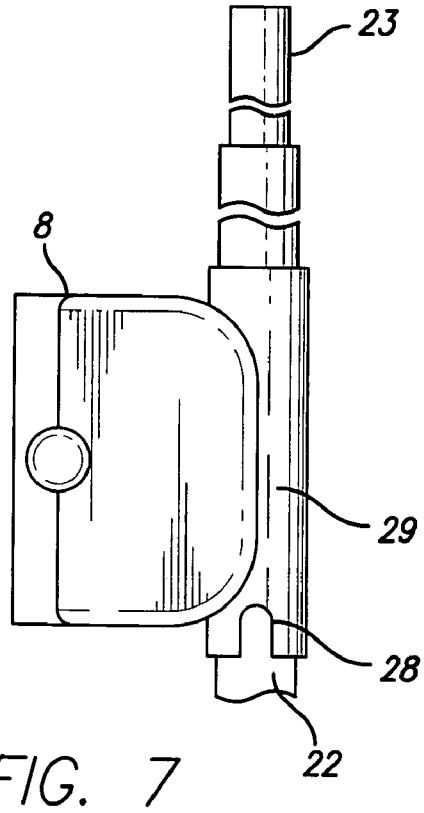
FIG. 7 is a side view of the same structure as in FIG. 6.

As shown in FIGS. 6 and 7, in between each bracket 8 a cylindrical support 29 is welded to the cross member 24. Each support 29 supports one parallel tube 22. The tubes 22 slide through the supports 29 freely until being stopped at one end by pins 30 in the intermediate position (see FIG. 3) or on the other end by the first rung 13 in the storage position (see FIG. 2). In the rear of the supports 29, which are fixed, e.g. by welding, to the cross member 24, there is a cut-out 28. Cut-out 28 slidably receives the pin or rod 30 when the tubes 22 are pulled through or extended through supports 29.

Figure 2:
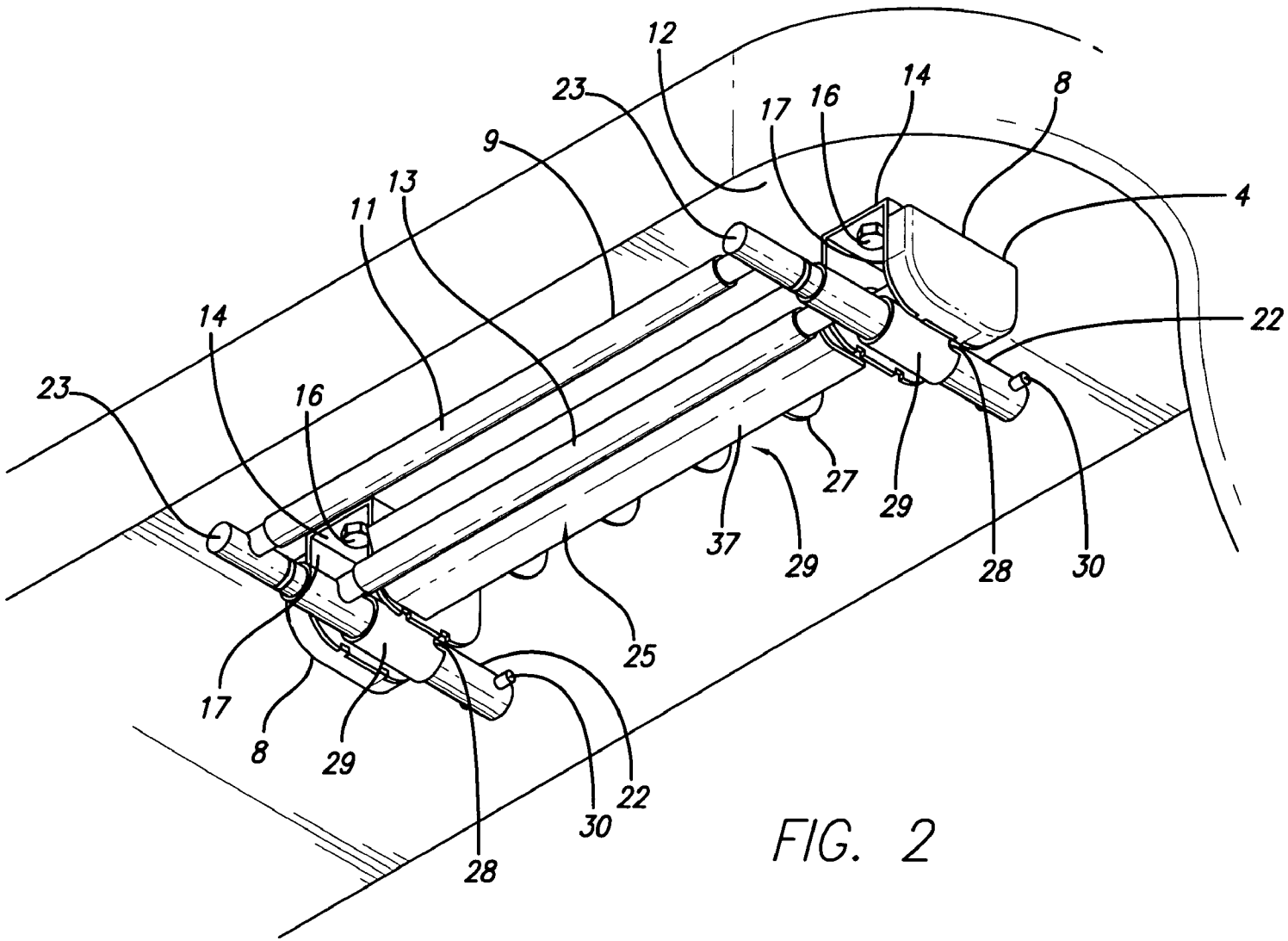
FIG. 2 is an enlarged perspective view of the ladder of FIG. 1.
Figure 3:
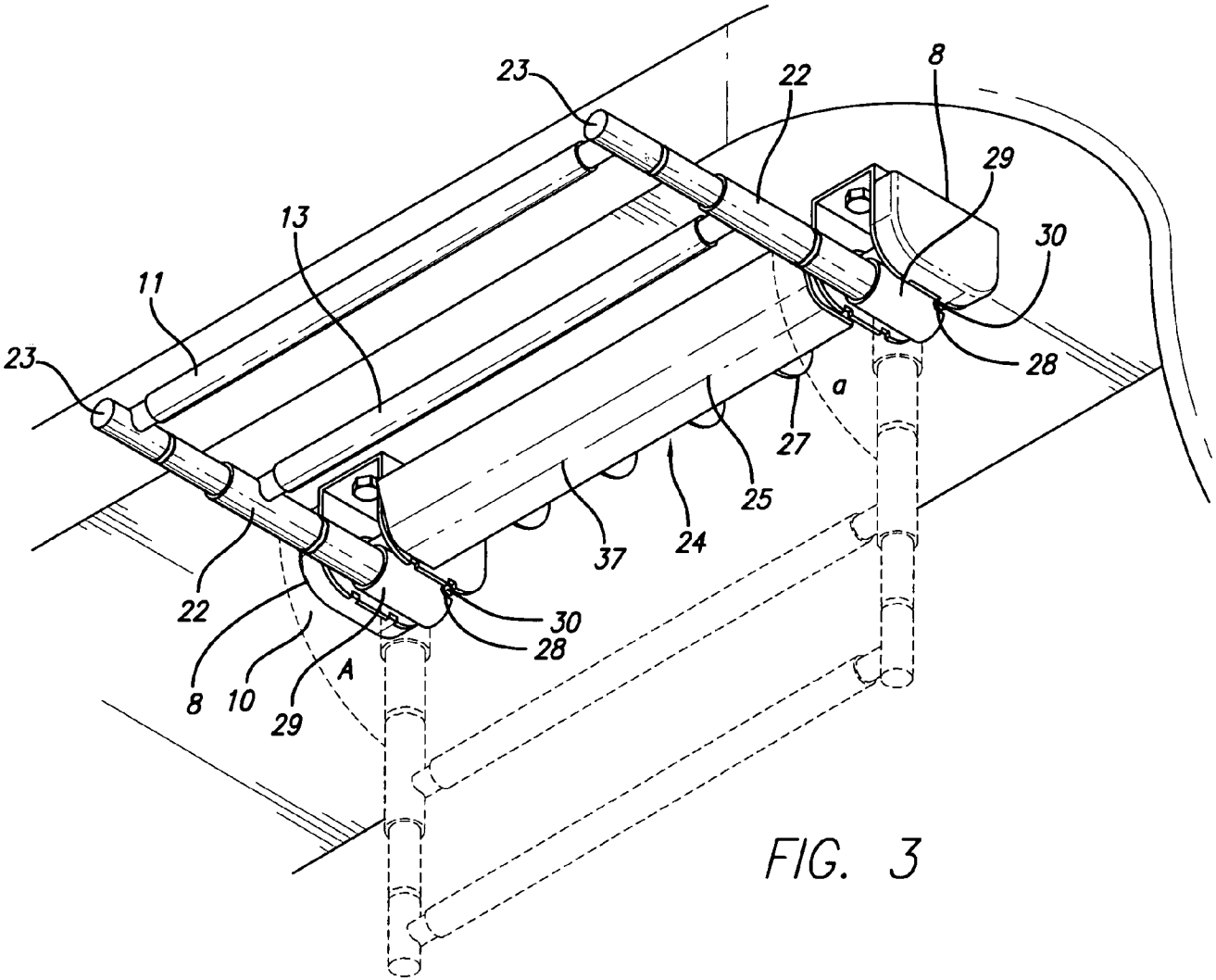
FIG. 3 is a view similar to FIG. 2 showing the ladder in an extended and intermediate position in solid lines and in an in-use position in phantom.

With continued reference to FIGS. 2 and 3, operation of the step will now be described. In the retracted (storage) position as shown in FIG. 2, the ladder is either level or at an angle, e.g., a shallow angle of approximately six or ten degrees. It is held up sufficiently by the strength of the torsion springs. While there may be some play, generally this is not of concern. If it is, additional support could be provided such as a strap connected to the stern of the boat or a spring clip catch fastened to the stern, or other structure as would be evident to one of ordinary skill in the art.

To use the ladder a person on the boat leans over the stern and pulls the ladder outward. If it is a two-rung ladder, this person pulls out at least the base rung and may pull out both rungs. This same procedure may be followed by someone in the water who wants to get onto the boat. The ladder will then be in an intermediate position as shown in FIG. 3. The person in the water or on the boat then presses down on the ladder or pulls the ladder down rotating the ladder through an angle A (usually about 90°) against the bias of the torsion spring 32. The ladder can now be used to enter or exit the boat. The ladder is in the position ("use position") shown in phantom in FIG. 3.

In order to prevent injury to the user, especially a person exiting the boat 2 or personal watercraft, a preferred embodiment of the present invention includes a locking assembly 37 to lock the ladder into the use position until actuated by the user. Such a locking assembly is shown in FIG. 8.

Welded to the cross member 24 are washers 27 or rings. Preferably, there are four evenly spaced washers 27. Also extending in between each bracket is a plate 25 which is preferably a bent plate. Because cross member 24 is fixed to supports 29 and thus is fixed to ladder 9, cross member 24 is rotated by the torsion spring 32 in the same direction as the ladder 9, which is biased into the storage position.

Figure 4:
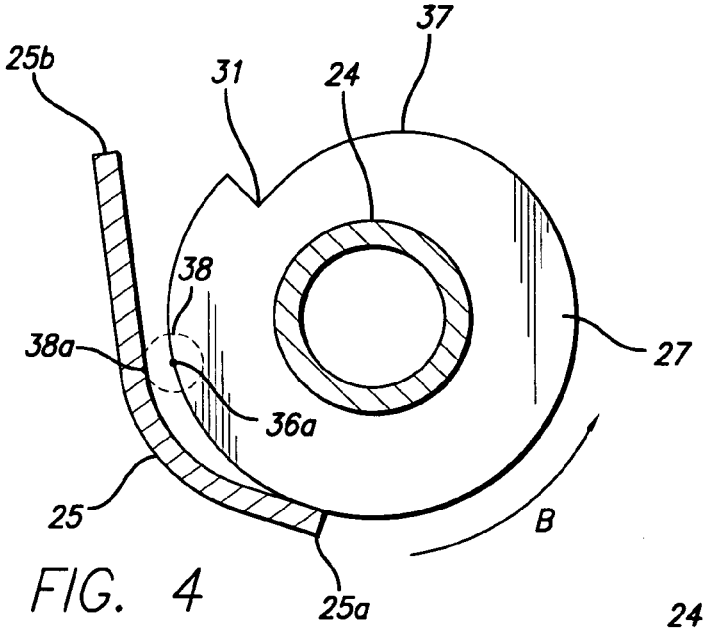
FIG. 4 is an enlarged sectional view showing one end of a bent plate of the locking mechanism resting against a washer when the ladder is in a storage position.
Figure 4A:
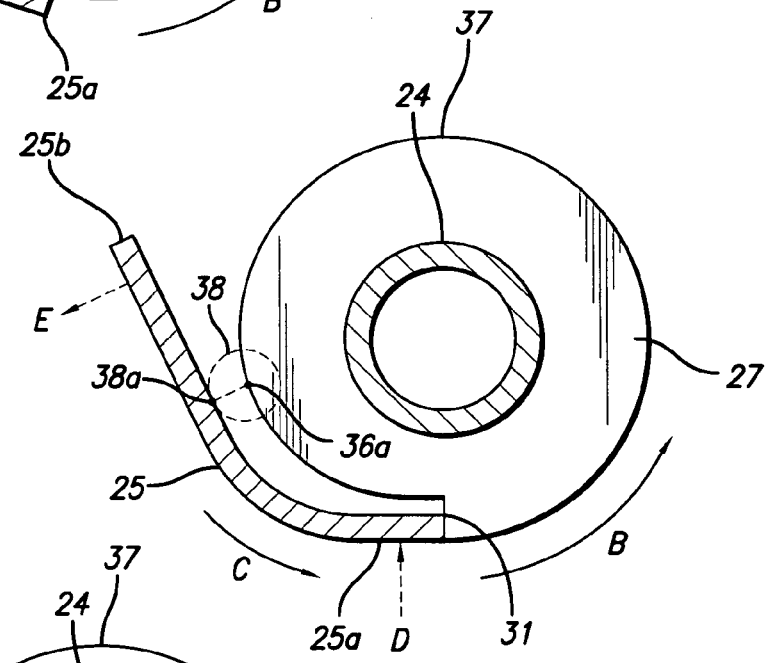
FIG. 4A is an enlarged sectional view similar to FIG. 4 but showing the locking mechanism in the locked position with the end of the bent plate fitting into a notch of the washer.
Figure 5:
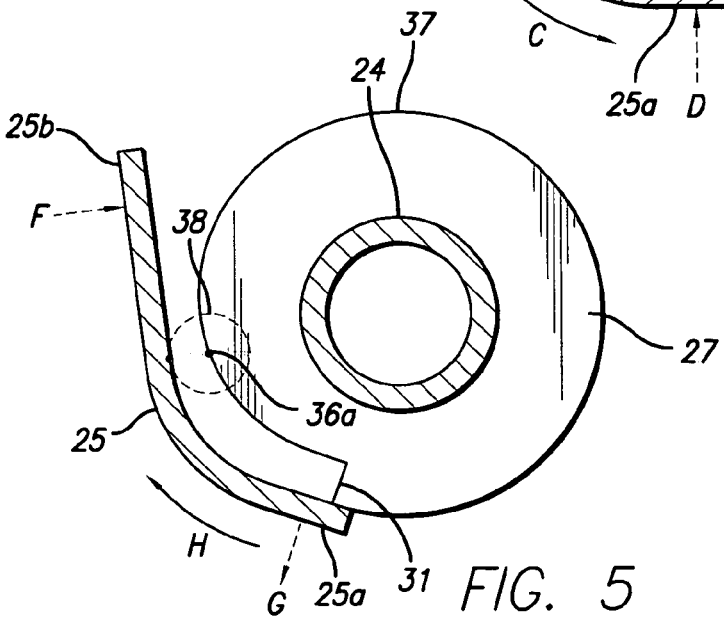
FIG. 5 is an enlarged sectional view similar to FIG. 4 but showing the locking mechanism in an actuated position with the one end being just above the notch of the washer.

Each washer 27 has a notch 31 in the same circumferential position, as best shown in FIGS. 4, 4A and 5. The notch 31 is preferably at an angle that is slightly smaller than 90° with the washer's circumference to form a tooth or gripping mechanism. The lock assembly further includes bent plate 25 which is rotatable around an axis formed by two small rods 36 (or one long rod) that extend from each bracket and end just before the first washer on its respective side. The bent plate 25 is fixed to, e.g. by welding, two cylindrical sleeves 38 which wrap around rods 36. This allows the bent plate 25 to rotate about the axis 36*a* formed by rods 36.

There is also a torsion spring 34 which biases bent plate 25 in a counterclockwise direction shown by arrow C in FIG. 4A. One end 34*a* of spring 34 is fixed, e.g. welded, to bent plate 25 or fixed to a sleeve 38, and the other end 34*b* fits into a side wall 17 of bracket 8. The bias of spring 34 causes the bottom of bent plate 25*a* to press against the washers 27. In the storage position shown in FIG. 4, end 25*a* of the bent plate 25 rests against the washers 27 locking the rod 24 from rotating, thereby locking the ladder from rotating.

When the user rotates ladder 9 counterclockwise (arrow B in FIG. 4) about 90° or a little more than 90° so that the ladder is slightly past the use position, notch 31 will be slightly past end 25*a* of bent plate 25. Bent plate 25 will now rotate in the direction of arrow C. End 25*b* rotates in the direction of arrow E and end 25*a* will move in the direction opposite to arrow D to engage the notch 31, thereby locking the ladder in place. Specifically, when the step is released by the user, the ladder 9 will slightly rotate towards the retracted position (clockwise) until the bottom of the bent plate 25*a* is pressed against the notches 31 of the washers 27. The ladder 9 is now locked into the use position so that the user can safely use the ladder to enter or exit the boat 2 or personal watercraft.

To release the locking assembly, the user pushes against the top of the bent plate 25*b* in the direction shown by arrow F in FIG. 5. This causes the opposite end 25*a* to move in the direction of arrow G and bent plate 25 to rotate along the axis 36 in a clockwise direction (shown by arrow H) against the spring bias so that the end 25*a* of the bent plate 25*a* radially clears notches 31 of washers 27. The user can then release ladder 9 and allow it to rotate back into the intermediate position as shown in FIG. 3. In the intermediate position, ladder 9 is preferably above horizontal by a sufficient amount that gravity will retract or assist in retracting tubes 23 into base tubes 22 and base tubes 22 will retract too into the position of FIG. 2. The user may assist in this retraction.

A second embodiment described in U.S. Pat. No. 5,970,905 could also be adapted to include the present locking mechanism.

Although the invention has been described using specific terms, devices, and/or methods, such description is for illustrative purposes of the preferred embodiment(s) only. Changes may be made to the preferred embodiment(s) by those of ordinary skill in the art without departing from the scope of the present invention, which is set forth in the following claims. In addition, it should be understood that aspects of the preferred embodiment(s) generally may be interchanged in whole or in part.

What is claimed is:

1. A step assembly for a craft, the step assembly comprising:

a U-shaped base step having two elongate sides and a rung extending therebetween; and two mounting elements for pivotally supporting the base step proximate each of the ends of the sides, each mounting element comprising means for fixing the element to a craft for providing a pivot axis for enabling rotation of the base step between a first position where the base step extends substantially downward for use by a person trying to embark on or disembark from the craft, and a second position where the base step is rotationally retracted with respect to the first position, and means for biasing the base step to rotationally retract by rotating from the first position to the second position, wherein the base step has a locking mechanism for locking the base step into the first position against the means for biasing, the locking mechanism including a rod extending from each bracket and rotatable with respect thereto, the base step being fixed with respect to the rod for rotating with the rod, and the rod having a cam surface thereon, the locking mechanism also comprising a plate, the plate having biasing means for biasing the plate in an opposite rotational direction as the ladder, the plate being adapted for engaging the cam surface in the locked position to hold the rod from rotating, and the plate being manually movable in the same rotational direction of the step and rod to release the locking mechanism in response to pressing on the plate to move the plate in the same rotational direction as the bias of the step.

2. The step assembly of claim 1, wherein the means for biasing further comprises a torsion spring.

3. The step assembly of claim 1, wherein the rod has rings fixed there around, and the cam surface is formed in the circumference of the rings.

4. The step assembly of claim 3, wherein the cam surface comprises a notch in each ring.

5. The step assembly of claim 3, wherein each of the rings is disposed between the mounting elements.

6. The step assembly of claim 1, wherein the plate is pivotably mounted with respect to the mounting elements, and the plate disengages from the cam surface in response to manually pivoting the plate.

7. The step assembly of claim 1, wherein the plate is pressed against the rings.

8. The step assembly of claim 4, wherein the plate has a bend and fits into the notch of each ring when the ladder is in the first position.

9. A step assembly for a craft, the step assembly comprising:

U-shaped base step having two elongate sides and a rung extending therebetween, and two mounting elements for pivotally supporting the base step proximate each of the ends of the sides, each mounting element comprising means for fixing the mounting element to a craft for providing a pivot axis for enabling rotation of the base between a first position where the base step extends substantially downward for use by a person trying to embark on or disembark from the craft, and a second position where the step is rotationally retracted with respect to the first position, and means for biasing the base step to rotationally retract by rotating from the first position to the second position, where the step has a locking mechanism for locking the step into the first position against the means for biasing, the locking mechanism including an elongate member extending from each mounting element and rotatable with respect thereto, and the base step being rotatable with the elongate member, and the elongate member having a cam surface therein, the locking mechanism also comprising a plate, the plate having biasing means for biasing the plate in an opposite rotational direction as the ladder, and for engaging the cam surface to physically hold the elongate member from rotating and thereby lock the rotation of the ladder, and the plate being manually movable in the same rotational direction of the step and elongate member to release the locking mechanism in response to pressing on the plate to move the plate in the same rotational direction as the bias of the step.

10. The step assembly of claim 9, wherein the biasing means for the plate comprises torsion springs.

11. The step assembly of claim 10, wherein there are means connected to the mounting elements and means connected to the plate for forming a pivot axis for the plate to rotate in a teeter-totter fashion.

12. The step assembly of claim 9, wherein biasing means for biasing further comprises a torsion spring.

13. A step assembly for a craft, the step assembly comprising:

U-shaped base step having two elongate sides and a rung extending therebetween, and two mounting elements for pivotally supporting the base step proximate each of the ends of the sides, each mounting element comprising means for fixing the element to a craft for providing a pivot axis for enabling rotating of the base between a first position where the base step extends substantially downward for use by a person trying to embark on or disembark from the craft, and a second position where the step is rotationally retracted with respect to the first position, and means for biasing the base step to rotationally retract by rotating from the first position to the second position, wherein the step has a locking mechanism for locking the step into the first position against the means for biasing, the locking mechanism including an elongate member extending from each bracket for moving the base step, and the elongate member having a cam surface therein, the locking mechanism also comprising a plate, the plate having biasing means for biasing the plate in an opposite rotational direction as the ladder, so that when the ladder is in a first position one end of the plate is biased radially inward with respect to the cam surface, and the cam surface having means for engaging the one end of the plate to thereby lock the elongate member and thereby lock the ladder against rotation from the first use position to the second retracted position when the plate is in a locking position, and when the plate is in an unlocking position with the one end of the plate disengaged from the means for engaging, the elongate member may freely rotate so that the ladder may freely rotate from the use position to the retracted position, and the plate being manually movable in the same rotational direction of the step and elongate member to release the locking mechanism in response to pressing on the plate to move the plate in the same rotational direction as the bias of the step.

14. The step assembly of claim 13, wherein the means for engaging comprises notches.

15. The step assembly of claim 13, wherein means for engaging comprises notches, and the one end of the plate is engaged with the notches when the plate is in the locking position.

16. The step assembly of claim 13, wherein the plate disengages from the means for engaging in response to manually rotating the plate against the bias of the spring.

* * * * *